US011305543B2

(12) United States Patent
Fort Filgueira et al.

(10) Patent No.: US 11,305,543 B2
(45) Date of Patent: Apr. 19, 2022

(54) PRINT HEAD MAINTENANCE

(71) Applicant: HEWLETT-PACKARD DEVELOPMENT COMPANY, L.P., Spring, TX (US)

(72) Inventors: Aleix Fort Filgueira, Sant Cugat del Valles (ES); Mauricio Seras Franzoso, Sant Cugat del Valles (ES); Sheila Cabello Cabrera, Sant Cugat del Valles (ES)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 16/499,894

(22) PCT Filed: Apr. 25, 2018

(86) PCT No.: PCT/US2018/029273
§ 371 (c)(1),
(2) Date: Oct. 1, 2019

(87) PCT Pub. No.: WO2019/209277
PCT Pub. Date: Oct. 31, 2019

(65) Prior Publication Data

US 2021/0323308 A1 Oct. 21, 2021

(51) Int. Cl.
*B41J 2/165* (2006.01)

(52) U.S. Cl.
CPC ..... *B41J 2/16535* (2013.01); *B41J 2/165* (2013.01); *B41J 2/16544* (2013.01); *B41J 2002/16573* (2013.01)

(58) Field of Classification Search
CPC .... B41J 2/16535; B41J 2/165; B41J 2/16544; B41J 2002/16573
See application file for complete search history.

(56) References Cited

U.S. PATENT DOCUMENTS

| | | | |
|---|---|---|---|
| 6,179,403 | B1 | 1/2001 | Xie et al. |
| 7,004,559 | B2 | 2/2006 | Aliaga |
| 9,827,796 | B1 | 11/2017 | Zheng et al. |
| 2006/0066665 | A1 | 3/2006 | Kachi et al. |
| 2012/0127231 | A1 | 5/2012 | Nukui |

FOREIGN PATENT DOCUMENTS

| | | | | |
|---|---|---|---|---|
| JP | 2012096367 | A | 5/2012 | |
| JP | 2644385 | A1 * | 10/2013 | ..... B41J 2/165 |
| WO | WO2014084843 | A1 | 6/2014 | |

* cited by examiner

*Primary Examiner* — Geoffrey S Mruk
(74) *Attorney, Agent, or Firm* — HP Inc. Patent Department

(57) ABSTRACT

Example apparatus is disclosed, including apparatus for print head maintenance, the apparatus comprising a print mead maintenance device to perform a print head maintenance operation on a print head during a printing process, and a controller to cause the print head maintenance device to perform the print head maintenance operation with a parameter based on an amount of print agent applied by the print head.

12 Claims, 2 Drawing Sheets

200

PRINT HEAD MAINTENANCE

BACKGROUND

When ejecting print agent through a print head nozzle, some print agent may remain on the print head. In some examples, this effect may be referred to as puddling. When the amount of print agent remaining on the print head is large enough, defects may start to appear in images printed by the print head. In some printing systems, if the print agent remaining on the print head dries out before the maintenance operation it may form a crust, and may at least partially prevent effective ejection of print agent from a nozzle Therefore, some printing systems include print head maintenance apparatus to perform a maintenance operation on the print head, such as for example a wiper to wipe the print head and remove at least some of the print agent remaining on the print head.

BRIEF DESCRIPTION OF DRAWINGS

Examples will now be described, by way of non-limiting example, with reference to the accompanying drawings, in which.

DETAILED DESCRIPTION

Figure 1:
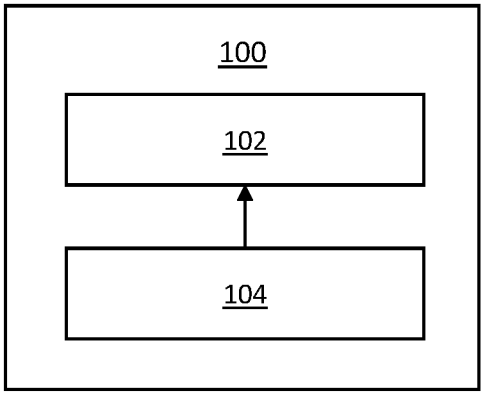
FIG. 1 is a simplified schematic of an example of apparatus for print head maintenance.

FIG. 1 is a simplified schematic of an example of apparatus 100 for print head maintenance. In some examples, the apparatus 100 for print head maintenance may be included within a printing device (e.g. a printer). The apparatus 100 comprises a print head maintenance device 102 to perform a print head maintenance operation on a print head during a printing process. The print head maintenance device 102 may in some examples be a device to remove print agent from a print head, such as for example a wiper. In some examples, the print head may be moved to a position where the print head maintenance device 102 can contact the print head to perform the print head maintenance operation. For example, the print head may be moved to a position where a wiper contacts the print head, and may also be moved relative to the wiper such that the wiper performs a wipe of the print head to remove at least some of any print agent that may remain on the print head.

In some examples, the print head maintenance operation may be performed on a portion of the print head that includes one or more nozzles for ejecting or dispensing print agent. For example, the print head maintenance operation may be performed on a nozzle plate of the print head.

The print head maintenance operation may be performed during a printing process. For example, the print head may make one or more passes over print media to apply print agent to the print media and form parts of an image thereon. After one or more passes of the print head, in some examples, the print head maintenance operation may be performed. In some examples, this may result in printing of the image being temporarily paused while the print head maintenance operation is performed. Once the print head maintenance operation has been completed, the print head may in some examples resume making one or more passes over the print media to form portions of the image thereon, for example of there are further portions of the image that have not yet been printed. In some examples, one or more additional print head maintenance operations may be performed during the printing process.

The apparatus 100 also includes a controller 104 to cause the print head maintenance device to perform the print head maintenance operation with a parameter based on an amount of print agent applied by the print head.

For example, the parameter may be a frequency of the print head maintenance operation and/or a force applied to the print head during the print head maintenance operation. In some examples, if more print agent is applied (e.g. dispensed or ejected) by the print head, more print agent may accumulate on the print head. Therefore, the frequency of the print head maintenance operation may be increased, for example the time and/or the number of print head passes between print head maintenance operations may be reduced. Additionally or alternatively, force applied to the print head during the print head maintenance operation may be increased if more print agent is applied, as there may be more print agent on the print head and/or there may be dried or crusted print agent on the print head.

In some examples, the controller 104 is to determine the amount of print agent applied by the print head based on a representation of an image to be printed during the printing process. For example, the representation (e.g. a digital representation such as a digital image) may indicate the amount of print agent(s) to be applied to print media to form the image, or may indicate for example information from which the amount of print agent(s) to form the image may be derived. Thus, the controller may in some examples determine the parameter for the print head maintenance operation based on the representation of the image. In some examples, the controller is to determine the amount of print agent applied by the print head based on a value of pixels in the representation of the image. For example, the controller may determine that the amount of print agent that the print head is to apply to print media to form the image is higher if the value of one or more pixels in the representation suggests that more print agent is needed to form that pixel on print media. Hence, in some examples the controller 104 may determine the parameter of the print head maintenance operation accordingly, for example by increasing the frequency and/or force of the print head maintenance operation.

In some examples, the print head maintenance device comprises a print head wiper, such that the print head maintenance operation comprises a wipe of the print head by the print head wiper.

In some examples, the parameter comprises a number of passes over print media of the print head between each print head maintenance operation.

In some examples, the parameter comprises a force applied to the print head during the print head maintenance operation. For example, the print head maintenance device 102 may be moveable relative to the print head (e.g. by a cam or actuator) such that the force applied during the print head maintenance operation may be varied. In some examples, the print head maintenance device 102 comprises a wiper that can be moved relative to the print head and includes a deformable element to contact and wipe the print head during the print head maintenance operation. The wiper may for example be moved closer to the print head during the maintenance operation to thereby increase the wiping force applied during the maintenance operation.

In some examples, the controller 104 is to cause the print head maintenance device to perform the print head maintenance operation with a parameter based on an amount of print agent applied by the print head, however the print head may apply a plurality of different print agents, such as for example to apply agents of different colors to print media. In some examples, the controller is to determine the parameter of the maintenance operation based on amounts of the plurality of print agents applied by the print head. For example, the controller 104 may increase the frequency and/or force of the print head maintenance operation in response to an increased amount of an individual one of the print agents being dispensed. In some examples, the controller 104 may not increase the print head maintenance operation frequency and/or force in response to an increase in a total amount of all print agents being dispensed, as the print head may dispense different print agents from different nozzles. The controller 104 may instead in some examples increase the print head maintenance operation frequency and/or force in response to an increase in an amount of print agent dispensed from a particular nozzle.

In some examples, the controller may determine a maintenance operation force so as to maintain the force substantially within a range of forces, and in some examples, the controller may determine the frequency of the maintenance operation to keep the frequency of the maintenance operations below a threshold frequency. In a further example, wherein both the frequency and the force are to be maintained within a set of operation limits, for an increasing amount of print agent applied by the print head, the force may be increased to an upper threshold. Once the upper threshold is increased, the force may be set to a lower threshold and the maintenance operation frequency may be increased. This may, in some examples, result in a relationship between force against amount of print agent that takes or resembles a sawtooth shape, such as for example the relationship shown in the graph 200 of FIG. 2.

Figure 2:
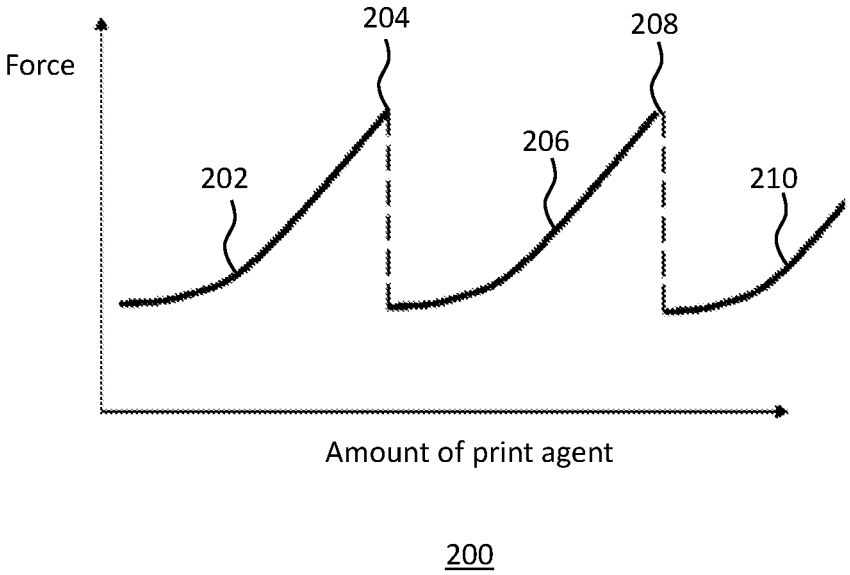
FIG. 2 is a graph of an example of a relationship between force of a print head maintenance operation and amount of print agent applied by a print head.

FIG. 2 is a graph 200 of an example of a relationship between force of a print head maintenance operation and amount of print agent applied by a print head. In a first section 202, the force generally increases with amount of print agent applied by the print head during a printing process. In the first section 202, the frequency of the maintenance operation does not change. At a point 204, the force reaches an upper threshold, and the force is therefore reset to a lower threshold, while the frequency of maintenance operations is increased. For example, to increase the frequency, the number of print head passes over print media may be decreased. As the amount of print agent increases further, the force once again increases as shown in section 206. At point 208, the force again reaches the upper threshold, whereby the force is reset to the lower threshold and the frequency is increased again. This generally sawtooth shape may in some examples be repeated one or more further times for larger amounts of print agent applied.

Figure 3:
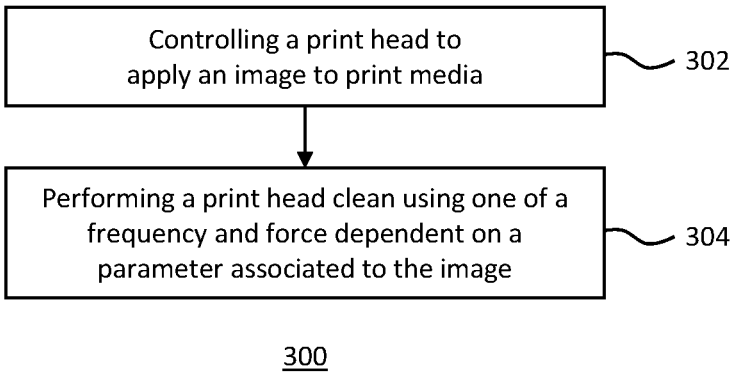
FIG. 3 is a flow chart of an example of a method of print head cleaning.

FIG. 3 is a flow chart of an example of a method 300 of print head cleaning. The method 300 comprises, in block 302, controlling a print head to apply an image to print media, and in block 304, performing a print head clean using one of a frequency and force dependent on a parameter associated to the image. The parameter associated to the image may be, for example, the amount of print agent to reproduce the image on a substrate during a printing process, or may be for example dependent on pixels in a representation of the image. The value of pixels in the representation may in some examples be related to the amount of print agent to produce the image on a substrate and hence the parameter of the print head clean can be based on the value of the pixels. For example, the parameter may be based on the average value of pixels of a particular color (e.g. one of red, green and blue, or one of cyan, magenta, yellow and black) in the image.

In some examples, the parameter of the print head maintenance operation or the frequency or force of a print head clean or maintenance operation may be dependent on a section of an image to be applied to print media and may be updated periodically. For example, an image to be applied to print media may be divided into sections, which may in some examples be equal-sized, and a parameter and/or frequency and/or force may be determined for each section, such as for example by analysing the pixels or any other property of that section of the image. Therefore, during a printing process for each section, the clean or maintenance operation may be performed in accordance with the parameter, frequency and/or force for that section.

Figure 4:
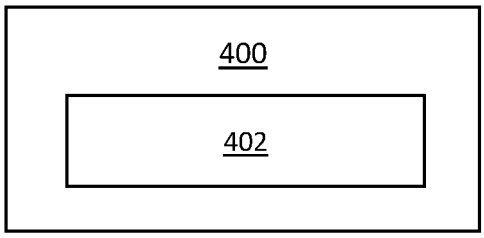
FIG. 4 is a simplified schematic of an example of a print head cleaning device.

FIG. 4 is a simplified schematic of an example of a print head cleaning device 400. The device may be included in an apparatus such as for example a printing apparatus. The print head cleaning device 400 includes print head cleaning apparatus 402 to perform print head cleaning of a print head according to a print head cleaning parameter. The print head cleaning device is to determine the print head cleaning parameter based on a parameter associated to an image (e.g. a section of a larger image) to be applied to a substrate by the print head. For example, the parameter may be indicative of an amount of print agent that will be used during a printing process to reproduce the image on print media. The print head cleaning parameter may be, for example, a frequency and/or force of the print head cleaning.

In some examples, the print head cleaning device 400 is to determine the print head cleaning parameter based on a digital representation of the image (or a parameter thereof). The digital representation may in some examples include pixels from which the print head cleaning parameter can be determined. In some examples, the digital representation may be received, for example from a user's device, or may be determined by the print head cleaning device 400 or an apparatus in which the device 400 is included, for example from other data. In some examples, the device 400 is to determine the amount of print agent applied by the print head based on an average intensity of pixels in the digital representation. The pixels may in some examples be of a particular color that corresponds to a particular print agent that may be used to reproduce the image on a substrate.

In some examples, the print head cleaning parameter comprises one of a frequency of the print head cleaning and a force of the print head cleaning.

In some examples, the print head cleaning parameter comprises a number of portions of the image applied to the substrate between each print head cleaning. In some examples, a portion of the image may correspond to a pass of the print head over the substrate to apply a portion of the image to the substrate. Thus, in some examples, the print head cleaning parameter may be the number of passes of the print head over the substrate between cleaning operations. In some examples, the number of portions or passes may decrease as the amount of print agent applied to the substrate (which may be derivable or estimated e.g. from a representation of the image to be applied) increases.

Figure 5:
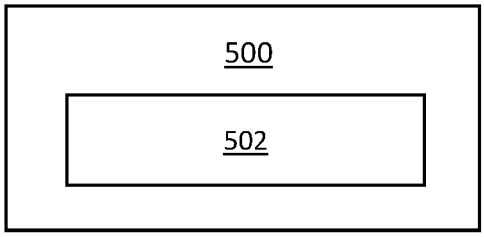
FIG. 5 is a simplified schematic of an example of a print head cleaning device.

FIG. 5 is a simplified schematic of an example of a print head cleaning device 500. The device may be included in an apparatus such as for example a printing apparatus. The print head cleaning device 500 includes print head cleaning apparatus 502 to perform print head cleaning of a print head according to a print head cleaning parameter. In some examples, the print head cleaning device is similar or identical to the print head cleaning apparatus 402 described above with respect to FIG. 4.

The print head cleaning apparatus 502 comprises a print head wiping apparatus to wipe the print head according to the print head cleaning parameter. In some examples, the force applied to the print head during a print head wipe by the print head wiping apparatus may be variable, for example by varying the position of the print head wiping apparatus, or by varying the relative position of the print head and the print head wiping apparatus when the print head is in contact with the print head wiping apparatus.

Examples in the present disclosure can be provided as methods, systems or machine readable instructions, such as any combination of software, hardware, firmware or the like. Such machine readable instructions may be included on a computer readable storage medium (including but is not limited to disc storage, CD-ROM, optical storage, etc.) having computer readable program codes therein or thereon.

The present disclosure is described with reference to flow charts and/or block diagrams of the method, devices and systems according to examples of the present disclosure. Although the flow diagrams described above show a specific order of execution, the order of execution may differ from that which is depicted. Blocks described in relation to one flow chart may be combined with those of another flow chart. It shall be understood that each flow and/or block in the flow charts and/or block diagrams, as well as combinations of the flows and/or diagrams in the flow charts and/or block diagrams can be realized by machine readable instructions.

The machine readable instructions may, for example, be executed by a general purpose computer, a special purpose computer, an embedded processor or processors of other programmable data processing devices to realize the functions described in the description and diagrams. In particular, a processor or processing apparatus may execute the machine readable instructions. Thus functional modules of the apparatus and devices may be implemented by a processor executing machine readable instructions stored in a memory, or a processor operating in accordance with instructions embedded in logic circuitry. The term 'processor' is to be interpreted broadly to include a CPU, processing unit, ASIC, logic unit, or programmable gate array etc. The methods and functional modules may all be performed by a single processor or divided amongst several processors.

Such machine readable instructions may also be stored in a computer readable storage that can guide the computer or other programmable data processing devices to operate in a specific mode.

Such machine readable instructions may also be loaded onto a computer or other programmable data processing devices, so that the computer or other programmable data processing devices perform a series of operations to produce computer-implemented processing, thus the instructions executed on the computer or other programmable devices realize functions specified by flow(s) in the flow charts and/or block(s) in the block diagrams.

Further, the teachings herein may be implemented in the form of a computer software product, the computer software product being stored in a storage medium and comprising a plurality of instructions for making a computer device implement the methods recited in the examples of the present disclosure.

While the method, apparatus and related aspects have been described with reference to certain examples, various modifications, changes, omissions, and substitutions can be made without departing from the spirit of the present disclosure. It is intended, therefore, that the method, apparatus and related aspects be limited only by the scope of the following claims and their equivalents. It should be noted that the above-mentioned examples illustrate rather than limit what is described herein, and that those skilled in the art will be able to design many alternative implementations without departing from the scope of the appended claims.

The word "comprising" does not exclude the presence of elements other than those listed in a claim, "a" or "an" does not exclude a plurality, and a single processor or other unit may fulfil the functions of several units recited in the claims.

The features of any dependent claim may be combined with the features of any of the independent claims or other dependent claims.

The invention claimed is:

1. An apparatus for print head maintenance, comprising:
- a print head maintenance device to perform a print head maintenance operation on a print head during a printing process; and
- a controller to:
  - determine an amount of print agent applied by the print head based on a value of pixels in a representation of an image to be printed during the printing process; and
  - cause the print head maintenance device to perform the print head maintenance operation with a parameter based on the determined amount of print agent applied by the print head, the parameter comprising a force applied to the print head during the print head maintenance operation.

2. The apparatus of claim 1, further comprising a print head wiper, and the print head maintenance operation comprises a wipe of the print head by the print head wiper.

3. The apparatus of claim 1, wherein the controller is to determine the amount of print agent applied by the print head based on an average intensity of the pixels in the representation of the image.

4. The apparatus of claim 1, wherein the value of the pixels in the representation of the image is indicative of the amount of print agent applied by the print head.

5. A method of print head cleaning, comprising:
- controlling a print head to apply an image to print media during a printing process;
- determining an amount of print agent applied by the print head based on a value of pixels in a representation of the image to be printed during the printing process;
- performing a print head maintenance operation with a parameter based on the determined amount of print agent applied by the print head, the parameter comprising a force applied to the print head during the print head maintenance operation.

6. The method of claim 5, wherein determining the amount of print agent applied by the print head based on the value of pixels in the representation of the image comprises determining the amount of print agent applied by the print head based on an average intensity of the pixels in the representation of the image.

7. The method of claim 5, wherein performing the print head maintenance operation comprises wiping the print head according to the parameter.

8. The method of claim 5, wherein the value of the pixels in the representation of the image is indicative of the amount of print agent applied by the print head.

9. A print head cleaning device comprising:

print head cleaning apparatus to perform a print head maintenance operation on a print head during a printing process, wherein the print head cleaning device is to:

determine an amount of print agent applied by the print head based on a value of pixels in a representation of an image to be printed during the printing process; and cause the print head cleaning apparatus to perform the print head maintenance operation with a parameter based on the determined amount of print agent applied by the print head, the parameter comprising a force applied to the print head during the print head maintenance operation.

10. The device of claim 9, wherein the print head cleaning device is to determine the amount of print agent applied by the print head based on an average intensity of the pixels in the representation of the image.

11. The device of claim 9, wherein the print head cleaning apparatus comprises a print head wiping apparatus to wipe the print head according to the parameter.

12. The device of claim 9, wherein the value of the pixels in the representation of the image is indicative of the amount of print agent applied by the print head.

* * * * *